US005358244A

United States Patent [19]

Kaminkow et al.

[11] Patent Number: 5,358,244

[45] Date of Patent: Oct. 25, 1994

[54] PINBALL MACHINE WITH MOVABLE BALL RETRIEVAL TARGET ASSEMBLY

[75] Inventors: Joseph E. Kaminkow, Arlington Heights; Edwin Cebula, West Chicago, both of Ill.

[73] Assignee: Data East Pinball, Inc., Melrose Park, Ill.

[21] Appl. No.: 104,823

[22] Filed: Aug. 10, 1993

[51] Int. Cl.[5] ..... A63F 7/30

[52] U.S. Cl. ..... 273/121 A; 273/121 R; 273/118 R; 273/118 A

[58] Field of Search ..... 273/118–125, 273/127 R, 127 B, 127 C, 127 D

[56] References Cited

U.S. PATENT DOCUMENTS

| | | | |
|---|---|---|---|
| 4,620,706 | 11/1986 | Ijidakinro | 273/127 R X |
| 4,840,375 | 6/1989 | Lawlor et al. | 273/119 A X |
| 5,120,059 | 6/1992 | Oursler | 273/121 A |
| 5,123,647 | 6/1992 | Lawlor et al. | 273/121 A |
| 5,158,292 | 10/1992 | Hanchar | 273/121 A |

FOREIGN PATENT DOCUMENTS

92/09343 6/1992 World Int. Prop. O. ..... 273/121 A

*Primary Examiner*—Vincent Millin
*Assistant Examiner*—Raleigh W. Chiu
*Attorney, Agent, or Firm*—Gerstman, Ellis & McMillin, Ltd.

[57] ABSTRACT

A pinball machine in which a movable target assembly is provided. The movable target assembly retrieves and seemingly devours the pinball sending the ball to another part of the playfield where it is either put back into play or is removed from action and placed in the ball reservoir. In playing the pinball game, the player attempts to place the ball in a target within reach of the movable target assembly. The assembly then pivots towards and picks up the ball. The ball is then seemingly swallowed by the movable target assembly, and is sent, through the assembly and under the playfield, back out to a second location on the playfield.

26 Claims, 4 Drawing Sheets

PINBALL MACHINE WITH MOVABLE BALL RETRIEVAL TARGET ASSEMBLY

FIELD OF THE INVENTION

The present invention concerns a novel pinball machine with a movable ball retrieval target assembly on the playfield.

BACKGROUND OF THE INVENTION

The object of pinball machines is to entertain the player of the game as well as the spectators. Player and spectator interest in pinball machines is short lived in that most pinball machines repeat the same types of play and it does not take long for such repetition to become monotonous. Pinball machine designers are, therefore, always trying to come up with new and varied methods of playing pinball so as to replace those machines that have become monotonous and to increase the life span of new pinball machines. These methods include the use of targets in different and varied manners and the design and construction of different types of targets and target assemblies.

It is therefore an object of the present invention to provide a means for making a pinball game interesting for as long as possible. It is another object of the present invention to provide a target that is entertaining to watch. It is another object of the invention to provide a target assembly on a pinball machine that is easy and economical to construct and use.

Other objects and advantages of the present invention will become apparent as the description proceeds.

SUMMARY OF THE INVENTION

In accordance with the present invention a pinball machine having a housing and a playfield is provided. A motor assembly and a ball retrieval location are also provided and are carried within the housing. A movable ball retrieval assembly is provided in the housing and is movably connected to the motor assembly.

The motor assembly is actuatable to move the ball retrieval assembly on the playfield from a first position to a second position. The ball retrieval assembly retrieves the ball and the motor assembly is actuated to return the ball retrieval assembly to its first position.

In the illustrative embodiment, the ball retrieval assembly is an animal-shaped target assembly resembling a Tyrannosaurus Rex dinosaur. A first motor assembly and a second motor assembly are provided and are carried within the housing. The animal-shaped assembly, comprising an animal-shaped head, with a pivoting lower jaw, an animal neck and an animal body, is provided in the housing and is adapted for retrieving balls. The animal-shaped assembly is rotationally and pivotally connected to the motor assemblies.

The first motor assembly is actuatable to rotate the animal-shaped assembly on the playfield. The second motor assembly is actuatable to pivot the animal-shaped assembly from a first upright position to a second, non-upright, position. The animal-shaped assembly is pivoted so as to bring the assembly proximal to a ball on the playfield. An electromagnet, also provided, is actuatable to open and close the lower jaw of the animal-shaped head to allow the ball to be retrieved by the animal-shaped assembly. The ball, once retrieved, is passed into the animal body and out through various means to the playfield to resume play.

In another embodiment the animal-shaped target assembly retrieves a ball from the playfield and then returns the ball to the same or another location on the playfield. A microcomputer in the pinball machine determines where the ball will be retrieved and released. In the play of that embodiment, a player places the ball within the reach of the animal-shaped assembly and a microcomputer operates the assembly to retrieve the ball and then release the ball in any one of a plurality of locations. Further, the animal-shaped assembly can include a number of ball holding devices, such as a switch, or a plurality of switches, with ball stopping means to keep the ball from rolling out of the animal-shaped assembly. In this way, more than one ball can be retrieved from the playfield and can be held until the microcomputer, or other means, determines that the ball or balls should be released.

A more detailed explanation of the invention is provided in the following description and claims and is illustrated in the accompanying drawings.

DETAILED DESCRIPTION OF THE ILLUSTRATIVE EMBODIMENT

Figure 1:
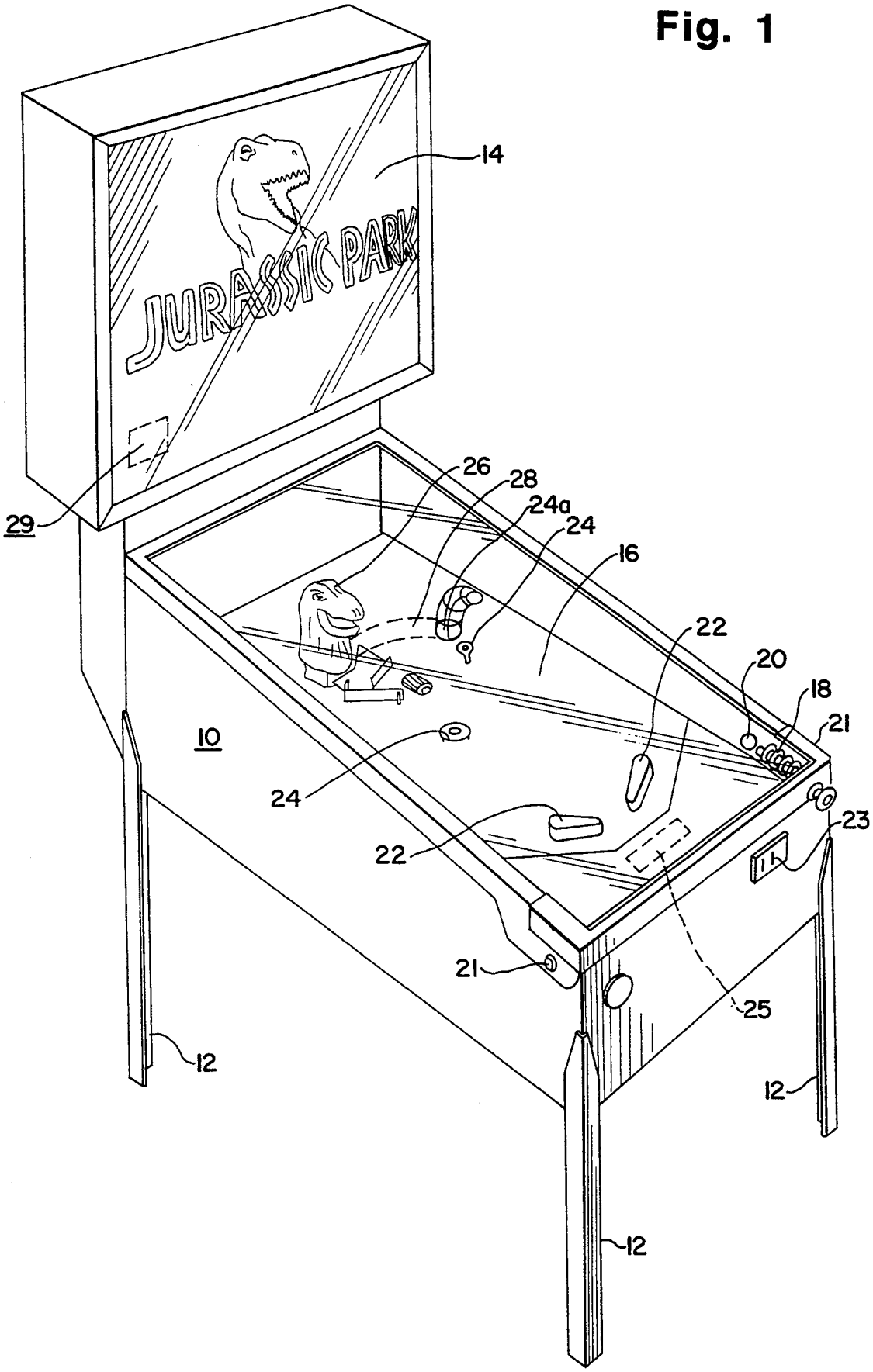
FIG. 1 is a perspective view of a pinball machine constructed in accordance with the principles of the present invention.

Referring to the drawings, FIG. 1 shows a pinball machine comprising a central body 10 attached to a plurality of legs 12, with a scoreboard 14 and a playfield 16. A ball launcher 18 is provided to propel a ball 20 onto the playfield 16 where ball 20 can be struck by a plurality of flippers 22 and can strike a plurality of targets 24. An animal-shaped target system 26 is provided on playfield 16 and is explained in detail below. A path 28 is defined below the playfield 16, by a "U" shaped-elongated member 28*a*, shown in FIG. 4, leading from below the animal-shaped target system 26 to another point on playfield 16. A vertical-up-kick assembly 24*a* may be included to return the ball 20 to the playfield 16 from member 28*a*. In other embodiments of the present invention, the path 28 may lead to a plurality of locations including to the pinball machine ball reservoir 25. Microcomputer means 29, flipper control buttons 21 and money accepting means 23 are provided with the pinball machine.

Figure 2:
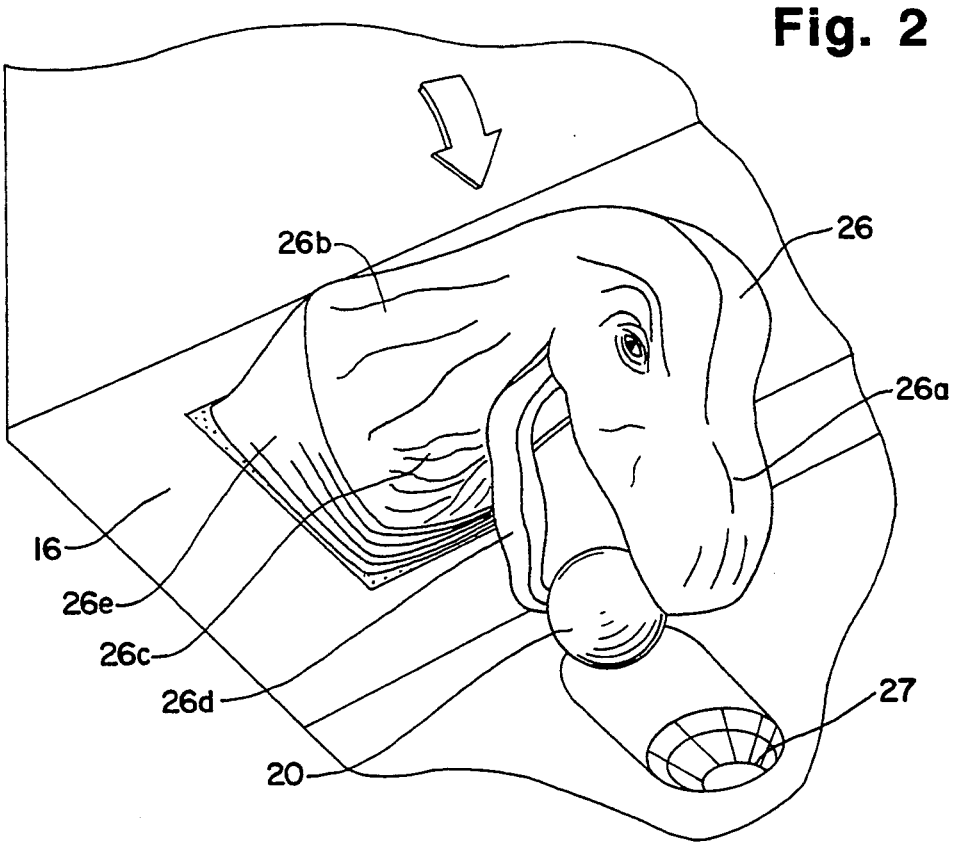
FIG. 2 is a perspective view of a target system in one position in the pinball machine of FIG. 1.
Figure 3:
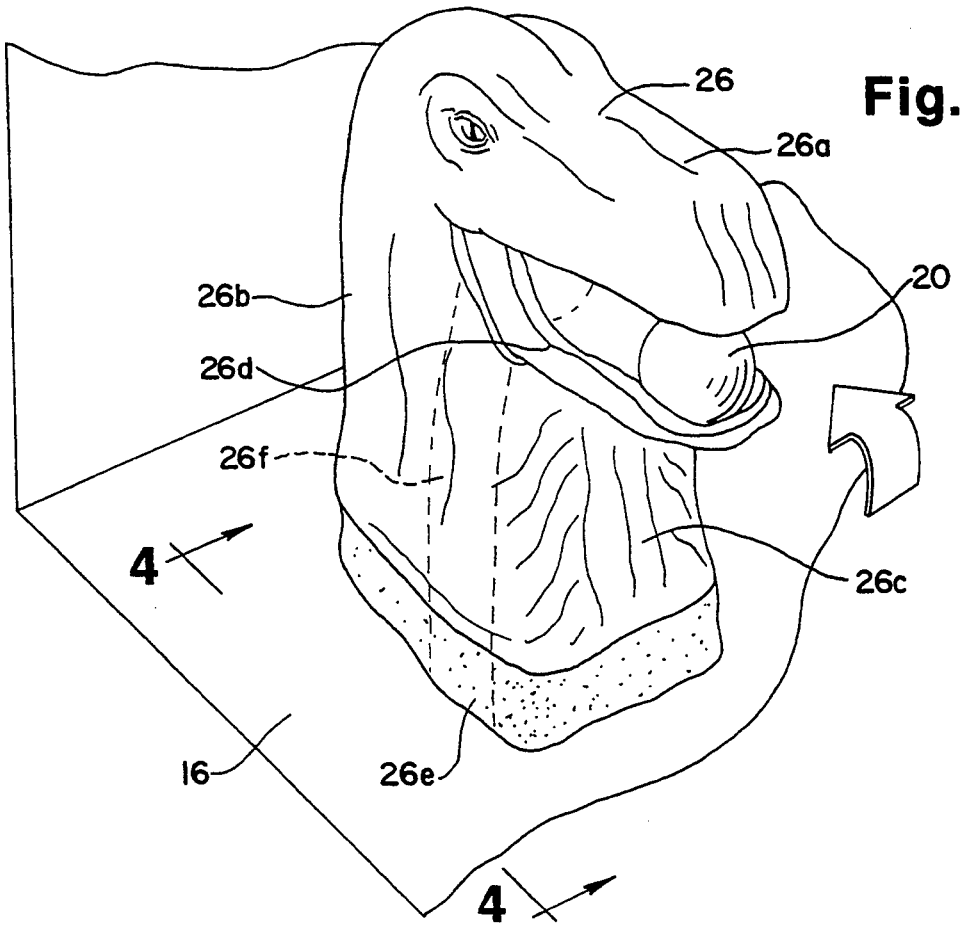
FIG. 3 is similar to FIG. 2 showing the target system in another position.

FIGS. 2 and 3 show animal-shaped target system 26 in greater detail. In FIG. 2, animal-shaped target system 26, here shaped like a Tyrannosaurus Rex dinosaur, is in a ball retrieval position. A ball 20 is retrieved from a first location, here illustrated as a microcomputer controlled ball ejector target 27, towards which animal-shaped target system 26 may pivot. Animal-shaped target system 26 is comprised of a head 26*a*, a back 26*b*, a neck 26*c*, a jaw 26*d* and a base 26*e*. When a ball 20 comes to rest in ejector target 27, microcomputer 29 senses the presence of the ball, actuating animal-shaped target system 26. In this embodiment, a microcomputer 29 may also cause the activation of ejector target 27, ejecting the ball from the animal-shaped target assembly 26 and back into play without causing the animal-shaped target assembly 26 to be actuated.

In FIG. 3 animal-shaped target system 26 is in the upright position with ball 20 held between head 26*a* and jaw 26*d*. From this position, the ball 20 may be caused to do any one of the following: be dropped through the animal-shaped target system 26, via path 26*f*, to a passage 28 below the playfield 16; be released onto playfield 16 in a second location; or be released back into the ball ejector target 27. Normal play may then resume.

Figure 4:
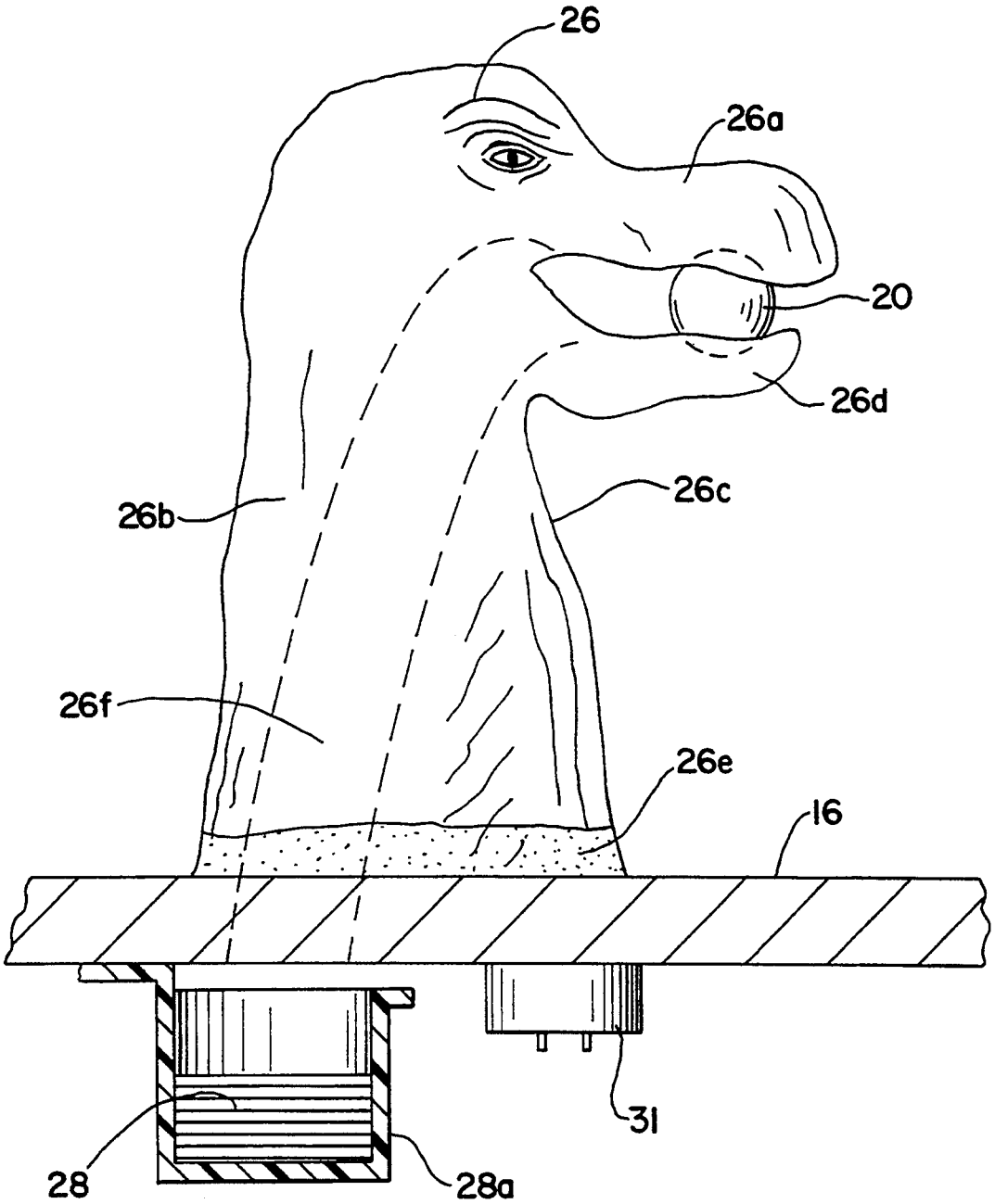
FIG. 4 is a partial cross-sectional elevation, taken along line 4—4 of FIG. 3.

FIG. 4 is a cross-sectional elevation taken along line 4—4 of FIG. 3. FIG. 4 shows animal-shaped target system 26 in its upright position after retrieval of ball 20. It can be seen from FIG. 4 that the ball 20 once having passed through animal-shaped target system 26, via pathway 26*f*, enters into passage 28 which guides pinball 20 back to vertical-up-kicker 24*a*, where the ball is returned to playfield 16. First motor 31, which produces rotational motion in animal-shaped target assembly 26, is also shown in FIG. 4.

Figure 5:
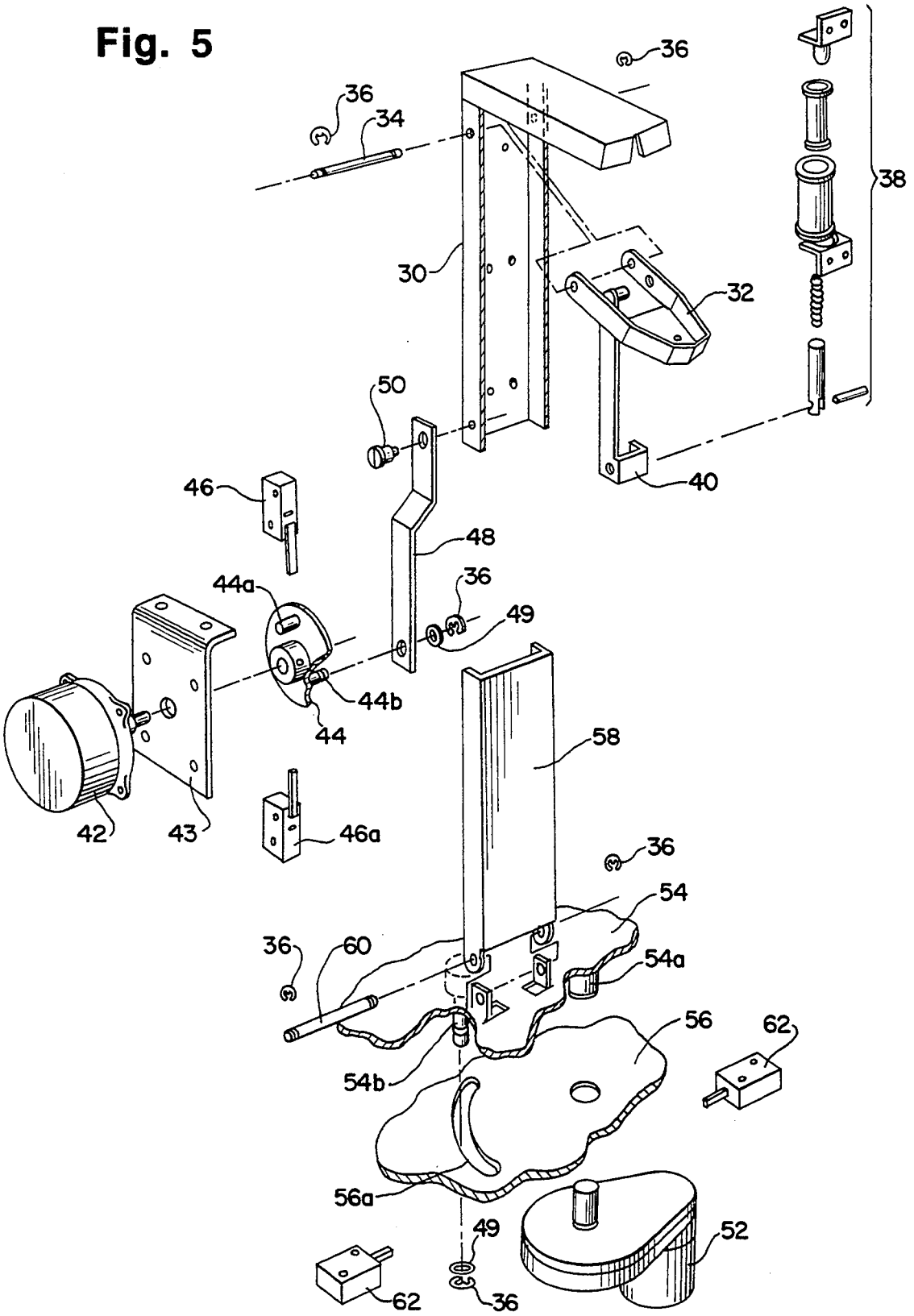
FIG. 5 is a fragmentary view of the inner workings of the target system of the present invention.

FIG. 5 shows the inner workings of animal-shaped target assembly 26. A back-and-head support 30 is rotationally attached to jaw support 32 by rod 34. "E" rings 36 are provided to keep rod 34 in place. Solenoid assembly 38 is provided attached to jaw 32 through link 40. Link 40 is rotationally attached to jaw support 32 in such a way that when solenoid assembly 38 is energized and de-energized link 40 causes jaw support 32 to pivot about rod 34. Jaw support 32 is mechanically attached to jaw 26*d* of animal-shaped target assembly 26. In this manner, jaw 26*d* is animated and the mouth of animal-shaped target assembly 26 opens and closes.

Electric motor 42 is provided to effect the pivoting of animal-shaped target assembly 26 towards a ball 20. Motor 42 is rotationally connected to motor cam assembly 44 through mounting bracket 43. Motor cam assembly 44 comprises legs 44*a* and 44*b*. Switches 46 are provided to limit the degree of pivot allowed and to effect the reversal of the action of motor 42, restoring the target assembly 26 to an upright position after first being pivoted forward. A crank arm 48 is rotationally attached to cam leg 44*b* by a washer 44 and an "E" ring 36 and is rotationally attached to back and head support 30 by a shoulder screw 50. In the action of pivoting, microcomputer 29 (see FIG. 1) activates motor 42 causing motor cam assembly 44 to rotate. As motor cam assembly 44 rotates, cam leg 44*b* causes crank arm 48 to rotate pivoting back-and-head support 30 forwards. In rotating motor cam assembly 44, leg 44*a* strikes one switch 46 upon causing a complete pivot and causes switch 46 to stop motor 42. Microcomputer 29 later causes motor 42 to reverse direction causing the reverse effect and pivoting the target assembly 26 to its first upright position. In this manner, target assembly 26 is pivoted forward towards playfield 16 and backwards to its first upright position. Another switch 46 is provided to stop the target assembly 26 from pivoting too far back. This pivoting action in concert with the previously described jaw movements, effects the recovery and devouring of the ball as described above.

Motor assembly 52 is provided to allow the target assembly 26 to rotate about its vertical axis. Motor assembly 52 is rotationally attached to upper mounting plate assembly 54 at coupling member 54*a* through lower mounting plate 56. A slot 56*a* defined in lower mounting plate 56 receives guide member 54*b* which is rigidly attached to upper mounting assembly 54. Guide member 54*b* is held to lower mounting plate 56 by a washer 49 and an "E" ring 36. Front support plate 58 is pivotally attached to upper mounting assembly 54 by rod 60 and "E" rings 36.

In the rotation of the target assembly 26, microcomputer 29 randomly activates motor assembly 52. Upper mounting assembly 54 is rotated about coupling member 54*a* by motor assembly 52. Slot 56*a* and switches 62 determine the degree of rotation and reverse the action of motor assembly 52 in a manner similar to that describe above with respect to the pivoting of the target assembly 26.

The inner workings shown if FIG. 5 are disposed within the target assembly 26 and beneath playfield 16 in such a manner as to cause the required effect and to remain hidden from the player's and spectators' view.

Although an illustrative embodiment of the invention has been shown and described, it is to be understood that various modifications and substitutions may be made by those skilled in the art without departing from the novel spirit and scope of the invention.

What is claimed is:

1. A pinball machine which comprises:

a housing which carries a playfield;

a motor assembly within said housing;

a ball detecting sensor;

at least one ball retrieval location;

a movable ball retrieval assembly, within said playfield housing, said ball retrieval assembly being movably connected to said motor assembly;

said motor assembly being responsive to said ball detecting sensor to move said ball retrieval assembly from a first position to said ball retrieval location to retrieve a stationary ball, and being operable to return said ball retrieval assembly to said first position.

2. The pinball machine of claim 1, wherein said ball retrieval assembly defines an opening whereby said retrieved ball is passed through said ball retrieval assembly and under said playfield.

3. The pinball machine of claim 1, wherein a microcomputer is provided to operate said ball retrieval assembly.

4. The pinball machine of claim 1, wherein said ball retrieval assembly has a cover which resembles at least a portion of an animal.

5. The pinball machine of claim 1, wherein said ball retrieval assembly resembles at least a portion of a Tyrannosaurus Rex dinosaur.

6. The pinball machine of claim 1, wherein said ball retrieval assembly has a cover which resembles at least a portion of an animal, rests upright and generally perpendicular to the plane of said playfield, and comprises a mouth, with a moveable lower jaw, into which a ball is retrieved when said ball retrieval assembly is first moved toward a generally parallel position with respect to said playfield and then moved back to said first upright position.

7. The pinball machine of claim 1, wherein said ball retrieval assembly comprises means for holding a ball.

8. The pinball machine of claim 1, wherein said ball retrieval assembly comprises means for retrieving and holding a plurality of balls.

9. The pinball machine of claim 1, wherein said ball retrieval assembly comprises means to retrieve the ball from a first location on said playfield, hold said ball, and then release said ball at a second location on said playfield.

10. The pinball machine of claim 1, wherein said ball retrieval assembly is pivotally connected to said motor assembly and said ball retrieval assembly pivots from said first position to said ball retrieval location.

11. A pinball machine which comprises:

a housing which carries a playfield;

a motor assembly within said housing;

a second motor assembly within said housing;

a ball detecting sensor;

at least one ball retrieval location;

a movable ball retrieval assembly, within said playfield housing, said ball retrieval assembly being movably connected to said motor assembly; said motor assembly being responsive to said ball detecting sensor to move said ball retrieval assembly from a first position to said ball retrieval location to retrieve a ball, and being operable to return said ball retrieval assembly to said first position; and said ball retrieval assembly comprising a vertical axis and said second motor assembly being movably connected to rotate said ball retrieval assembly about said vertical axis.

12. A pinball machine which comprises:

a housing carrying a playfield;

a motor assembly within said housing;

a ball detecting sensor;

a ball retrieval assembly, comprising a cover resembling at least a portion of an animal, having a moveable lower jaw for retrieving balls within said playfield housing, said ball retrieval assembly being pivotally connected through said playfield to said motor assembly;

said motor assembly being responsive to said ball detecting sensor to pivot said ball retrieval assembly from an upright position to a non-upright position proximal to a ball on said playfield and to return said ball retrieval assembly to said upright position;

said ball retrieval assembly being operable to open and close said moveable lower jaw to retrieve said ball from said playfield as said ball retrieval assembly is pivoted to said non-upright position.

13. The pinball machine of claim 12, wherein said ball retrieval assembly defines an opening whereby said retrieved ball is passed through said ball retrieval assembly and under said playfield.

14. The pinball machine of claim 12, wherein a microcomputer is provided to operate said ball retrieval assembly.

15. The pinball machine of claim 12, wherein said ball retrieval assembly resembles at least a portion of a Tyrannosaurus Rex dinosaur.

16. The pinball machine of claim 12, wherein said ball retrieval assembly comprises means for holding a ball.

17. The pinball machine of claim 12, wherein said ball retrieval assembly comprises means for retrieving and holding a plurality of balls.

18. The pinball machine of claim 12, wherein said ball retrieval assembly comprises means to retrieve the ball from a first location on said playfield, hold said ball, and then release said ball at a second location on said playfield.

19. A pinball machine which comprises:

a housing carrying a playfield;

a motor assembly within said housing;

a second motor assembly within said housing;

a ball detecting sensor;

a ball retrieval assembly, comprising a cover resembling at least a portion of an animal, having a moveable lower jaw for retrieving balls within said playfield housing, said ball retrieval assembly being pivotally connected through said playfield to said motor assembly;

said motor assembly being responsive to said ball detecting sensor to pivot said ball retrieval assembly from an upright position to a non-upright position proximal to a ball on said playfield and to return said ball retrieval assembly to said upright position;

said ball retrieval assembly being operable to open and close said moveable lower jaw to retrieve said ball from said playfield as said ball retrieval assembly is pivoted to said non-upright position; and said ball retrieval assembly comprising a vertical axis and said second motor assembly being movably connected to rotate said ball retrieval assembly about said vertical axis.

20. A pinball machine which comprises:

a housing carrying a playfield;

a ball detecting sensor;

a first motor assembly within said housing;

a second motor assembly within said housing;

an electromagnet assembly within said housing;

a ball retrieval assembly, comprising a cover resembling at least a portion of an animal, having a pivoting lower jaw adapted for retrieving balls, within said playfield housing, said ball retrieval assembly being rotationally connected to said first motor assembly and pivotally connected to said second motor assembly;

said first motor assembly being responsive to said ball detecting sensor to rotate said ball retrieval assembly on said playfield;

said second motor assembly being operable to pivot said ball retrieval assembly from an upright position to a non-upright position proximal to a ball on said playfield and to return said ball retrieval assembly to said upright position;

said electromagnet assembly being operable to open and close said moveable lower jaw to retrieve said ball from said playfield upon said ball retrieval assembly being first pivoted.

21. The pinball machine of claim 20, wherein said ball retrieval assembly defines an opening whereby said retrieved ball is passed through said ball retrieval assembly and under said playfield.

22. The pinball machine of claim 20, wherein a microcomputer is provided to operate said ball retrieval assembly.

23. The pinball machine of claim 20, wherein said ball retrieval assembly resembles at least a portion of a Tyrannosaurus Rex dinosaur.

24. The pinball machine of claim 20, wherein said ball retrieval assembly comprises means for holding a ball.

25. The pinball machine of claim 20, wherein said ball retrieval assembly comprises means for retrieving and holding a plurality of balls.

26. The pinball machine of claim 20, wherein said ball retrieval assembly comprises means to retrieve the ball from a first location on said playfield, hold said ball, and then release said ball at a second location on said playfield.

* * * * *